United States Patent [19]

Makita et al.

[11] Patent Number: 4,857,027

[45] Date of Patent: Aug. 15, 1989

[54] METHOD OF MANUFACTURING COLOR SCREEN STRUCTURE FOR A CATHODE RAY TUBE

[75] Inventors: Toshio Makita; Koichi Tago, both of Aichi, Japan

[73] Assignee: Sony Corporation, Tokyo, Japan

[21] Appl. No.: 242,216

[22] Filed: Sep. 9, 1988

[30] Foreign Application Priority Data

Sep. 25, 1987 [JP] Japan ..... 62-241936

[51] Int. Cl.[4] ..... H01J 9/20

[52] U.S. Cl. ..... 445/37; 228/159

[58] Field of Search ..... 445/30, 37; 313/403; 228/159, 160

[56] References Cited

U.S. PATENT DOCUMENTS

| | | | |
|---|---|---|---|
| 3,638,063 | 1/1972 | Tachikawa et al. | 313/403 |
| 4,380,042 | 4/1983 | Angelucci et al. | 228/159 X |
| 4,652,791 | 3/1987 | Palac et al. | 445/30 X |

*Primary Examiner*—Kenneth J. Ramsey

*Attorney, Agent, or Firm*—Hill, Van Santen, Steadman & Simpson

[57] ABSTRACT

A method of manufacturing a color screen structure for a CRT. The color screen structure comprises a frame consisting of a pair of parallel supporting members and a pair of connecting members interconnecting the pair of supporting members at the opposite ends thereof, and a color screen member provided with a plurality of parallel slits in the color screening region thereof, a pair of slots formed outside the color screening region respectively alongside the opposite outermost slits, and a pair of grooves previously formed respectively along lines corresponding to the outer upper edges of the supporting members of the frame. The color screen member is welded to the supporting members of the frame so that the grooves extend respectively alongisde the outer upper edges of the supporting members, and then the unnecessary portions of the color screening member are torn off along the grooves.

6 Claims, 4 Drawing Sheets

METHOD OF MANUFACTURING COLOR SCREEN STRUCTURE FOR A CATHODE RAY TUBE

BACKGROUND OF THE INVENTION

1. Field of the Invention

The present invention relates to a method of manufacturing a color screen structure for a cathode-ray tube (hereinafter abbreviated "CRT").

2. Description of the Prior Art

In manufacturing a color screen structure for a color CRT, for example, a so-called aperture grill assembly as shown in FIG. 6 having a plurality of slits for passing electron beams therethrough includes an aperture grill member 9 formed of a thin metallic plate, such as a cold rolled thin steel plate and provided with a plurality of slits 6. The plate is placed on a metallic frame 5 consisting of a pair of opposite supporting members 1 and 2 and a pair of substantially U-shaped elastic connecting members 3 and 4 interconnecting the respective opposite ends of the supporting members 1 and 2. An external force is applied to the supporting members 1 and 2 of the frame 5 so as to stress the supporting members 1 and 2 toward each other by a fixed deflection, and a moderate tensile load is applied to the aperture grill member 9 to hold the aperture grill member 9 tight with respect to Y—Y direction. The aperture grill member 9 is welded by seam welding to the supporting members 1 and 2, the external force is then removed from the supporting members 1 and 2, and then the unnecessary peripheral portions 8 of the aperture grill member 9 are removed. The aperture grill member 9 is provided with slots 10 in the opposite sides thereof with respect to X—X directions outside the central region having the slits 6 and thin metallic strips 7. The respective upper surfaces of the supporting members 1 and 2 of the frame 5 in contact with the aperture grill member 9 have a radius of curvature Rz and the respective outer side surfaces of the supporting members 1 and 2 have a radius of curvature Ry.

In the conventional method of manufacturing such a color screening structure, the peripheral portions 8 of the aperture grill member 9 are removed by shearing the aperture grill member 9 with a roller cutter 11 as shown in FIG. 7. In cutting the aperture grill member 9, the reduced portion of the roller cutter 11 rolls along the curved surface of the aperture grill member 9 while the roller cutter 11 cuts off the peripheral portion 8 by shearing the aperture grill member 9 between the cutting edge thereof and the corner of the supporting frane 1 or 2 of the frame 5.

In shearing off the peripheral portions 8 of the aperture grill member 9 with the roller cutter 11, it is possible that metallic scraps, such as burrs 13 formed in the cut surface of the aperture grill member 9 as shown in FIG. 7 and/or chips 14, are produced due to an inappropriate combination of the size of the frame 5 and the roller cutter 11, the variation of the inclination 8 of the side walls of the supporting members 1 and 2 or the use of an abraded roller cutter. These metallic scraps 13 and 14 stick firmly to the aperture grill assembly, are unable to be removed completely from the aperture grill assembly by the subsequent washing and demagnetizing processes and, in the worst case, remain on the aperture grill assembly even after the aperture grill assembly has been placed within the vacuum interior of a CRT causing discharge, to deteriorate the voltage rating of the CRT. Thus the use of the roller cutter 11 for cutting off the peripheral portions 8 of the aperture grill member 9 produces metallic scraps entailing such problems It is also possible to tear off the peripheral portions 8 along a welded seam 16 by taking advantage of the strength of the welded seam 16 as shown in FIG. 8 after seam-welding the aperture grill member 9 to the frame 5. This method of removing the peripheral portions 8 provides removal of the peripheral portions 8 without producing any metallic scrap. However, since the tearing force necessary for tearing off the peripheral portions 8 is proportional to the thickness of the aperture grill member 9, the greater the aperture grill member, the greater the tearing force will be. Furthermore, this method requires scrupulous attention to the control of the welded part and to the abrasion of the welding electrode roller to manufacture a color screening structure of satisfactory quality.

SUMMARY OF THE INVENTION

Accordingly, it is an object of the present invention to provide a method of manufacturing a color screen structure for a CRT, capable of easily cutting off the peripheral portions 8 of an aperture grill member without producing any metallic scrap.

To achieve the object of the invention, the present invention provides a method of manufacturing a color screen structure for a CRT having a frame 5 and a color screen member 21 welded to the frame 5, comprising steps of previously forming grooves 23 in the color screen member 21 along lines corresponding to the edges of the frame 5, and tearing off the peripheral portions 8 of the color screen member 21 along the grooves 23 after welding the color screen member 21 to the frame 5.

The grooves 23 are formed in a uniform width and uniform depth along the contour of the frame 5 in a curve having a radius of curvature corresponding to the radius of curvature Ry of the frame 5. The depth d of the grooves 23 is in the range of 20 to 50%, preferably, 22 to 40%, of the thickness t of the color screen member 21, and the width w of the grooves 23 is on the order of 100 $\mu$m.

Thus, according to the present invention, since the grooves 23 are formed previously in the color screen member 21, i.e., an aperture grill member, along cutting lines, and the unnecessary peripheral portions 8 of the aperture grill member 21, are torn off along the grooves 23 after welding the aperture grill member 21 to the frame 5, the tearing force necessary for tearing off the peripheral portions 8 along the grooves 23 is about one-tenth of the tearing force necessary for tearing off the peripheral portions 8 along the welded seam in the foregoing conventional method. Furthermore, the unnecessary peripheral portions 8 can properly be torn off regardless of the inclination 8 of the side wall of the supporting member 1,2 of the frame 5.

BRIEF DESCRIPTION OF THE DRAWINGS

The above and other objects, features and advantages of the present invention will become apparent from the following description taken in conjunction with the accompanying drawings, in which.

DETAILED DESCRIPTION OF THE PREFERRED EMBODIMENT

Figure 1:
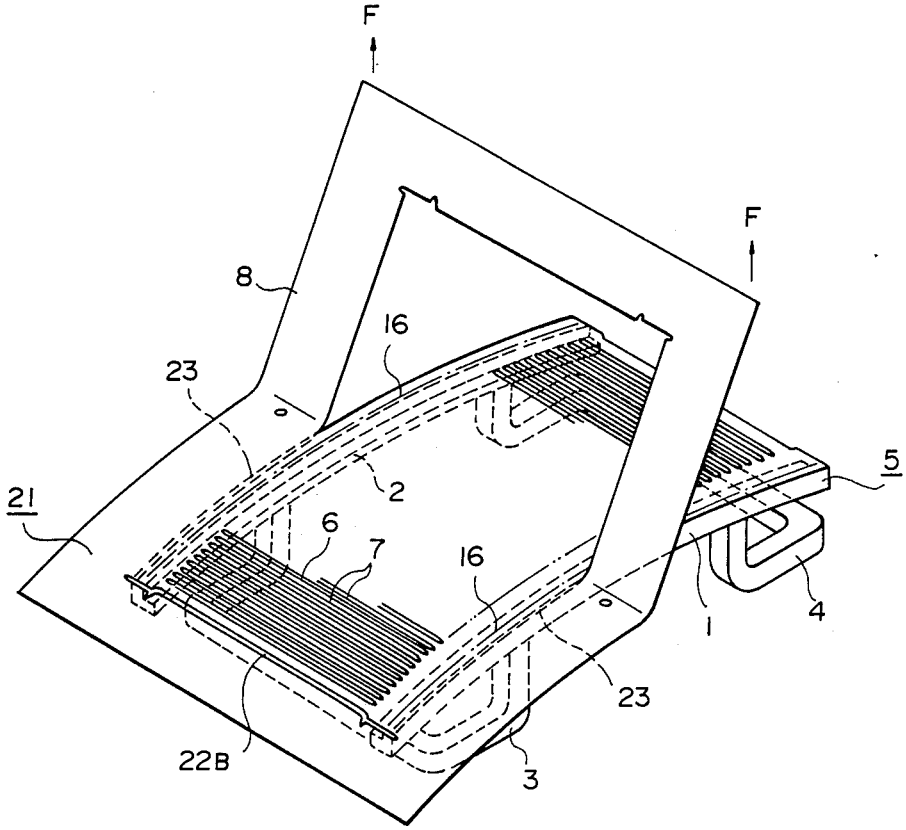
FIG. 1 is a perspective view of assistance in explaining a method of manufacturing a color screen structure for a CRT, in a preferred embodiment according to the present invention, showing a process of tearing off the unnecessary peripheral portions of an aperture grill member.
Figure 2:
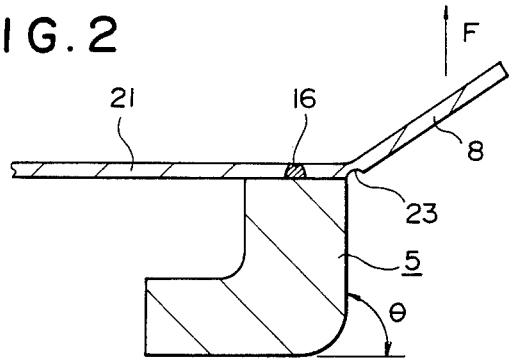
FIG. 2 is a sectional view of an essential portion of FIG. 1.
Figure 3:
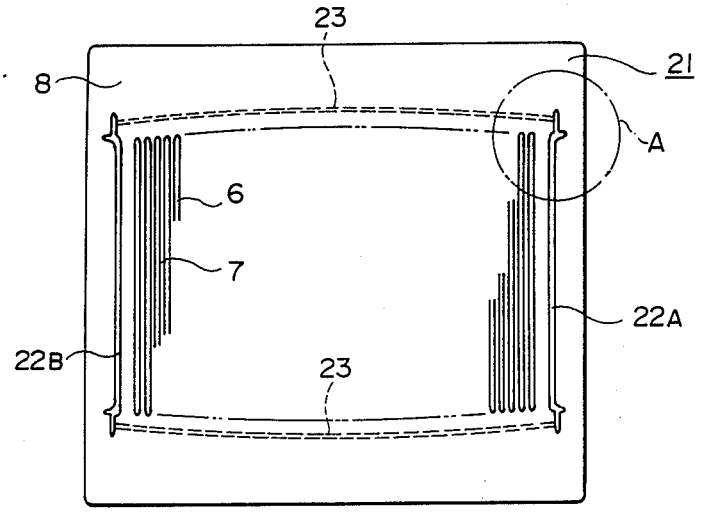
FIG. 3 is a plan view of a color screen member, i.e., an aperture grill member, for use in carrying out the method of manufacturing a color screen structure of the present invention.
Figure 4:
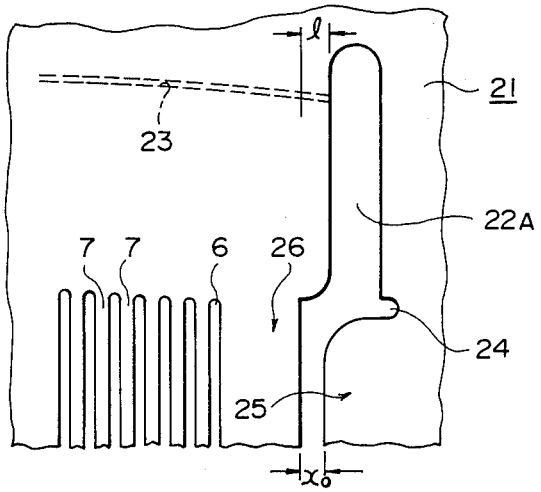
FIG. 4 is an enlarged fragmentary plan view showing a portion A of FIG. 3.
Figure 5:
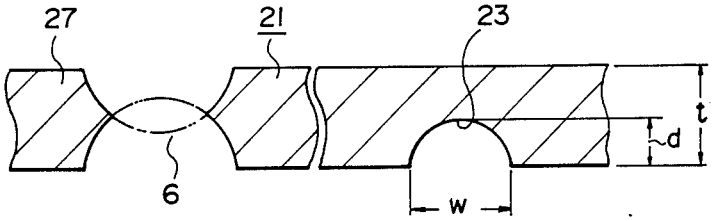
FIG. 5 is a fragmentary sectional view of an essential portion of a color screen member for use in carrying out the method of manufacturing a color screen structure according to the present invention.
Figure 6:
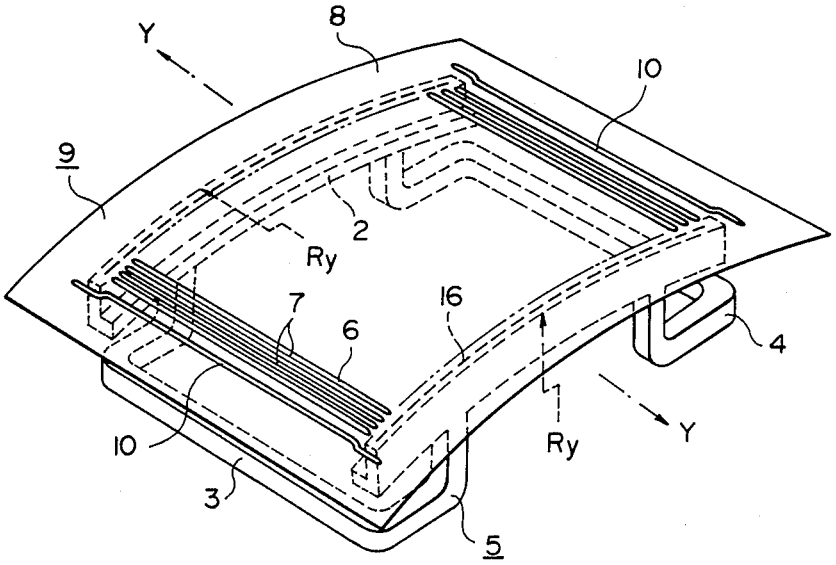
FIG. 6 is a perspective view of a color screen structure, of assistance in explaining a conventional method of manufacturing a color screen structure.

Referring to FIG. 1, there are shown a frame 5 consisting of a pair of opposite supporting members 1 and 2 and substantially U-shaped elastic connecting members 3 and 4 fixedly interconnecting the opposite ends of the supporting members 1 and 2, and an aperture grill member 21 attached to the frame 5. As shown in FIGS. 3 and 4, the aperture grill member 21 is formed of a thin metallic plate, such as a cold rolled thin steel plate, and is provided with a horizontal arrangement of a plurality of parallel vertical slits 6 demarcated by a plurality of narrow metallic strips 7 vertically extending from the upper and lower peripheral portions 8 of the aperture grill member 21. Slots 22A and 22B having a length sufficiently longer than that of the narrow metallic strips 7 are formed in the aperture grill member 21 respectively outside the opposite outermost slits 6. Grooves 23 are formed in the backside of the aperture grill member 21 so as to extend along the outer edges of the supporting members 1 and 2 respectively between the opposite ends of the slots 22A and those of the slot 22B in a curve having a radius of curvature corresponding to the radius of curvature Ry. The opposite ends of the grooves 23 merge into the corresponding end portions of the slots 22A and 22B. In this embodiment, the aperture grill member 21 has a thickness t of 0.1 mm and the grooves 23 have a depth d of 0.4, and a width 2 of 0.1 mm (FIG. 5). As shown in FIG. 4, the slots 22A and 22B are extended in parallel to the slits 6, and the opposite end portions of the slots 22A and 22B extending outside the extremities of the slits 6 are offset outward and have a width greater than the width $x_o$ of the intermediate portions extending alongside the slits 6. The slits 6 and the slots 22A and 22B are formed by an etching process. The intermediate portions of the slots 22A and 22B are formed in the small width $x_o$ so that a reduced amount of sediment is produced in forming the slots 22A and 22B to prevent the slits 6 from being clogged with the sediment produced in forming the slots 22A and 22B by an etching process. Bends each at the junction of the intermediate portion and the end portion of each of the slots 22A and 22B are projected to form recesses 24 to reduce the strength of elongate portions 25 of the aperture grill member 21, respectively extending alongside the intermediate portions of the slots 22A and 22B. Accordingly, elongate marginal portions 26 of the aperture grill member 21, respectively extending alongside the outermost slits 6 are not damaged by the elongate portions 25 in tearing off the unnecesaary peripheral portions 8 even if the elongate portions 25 touch the elongate marginal portions 26.

The slits 6, grooves 22A and 22B and grooves 23 of the aperture grill member 21 are formed simultanously by a selective etching process. As shown in FIG. 5, both sides of a thin metallic plate 27 for forming the aperture grill member 21 are etched to form the slits 6 and the slots 22A and 22B simultaneously, while the grooves 3 are formed by etching the backside of the thin metallic plate 27. Accordingly, the grooves 23 can be formed in the aperture grill member 21 without requiring any additional process. The grooves 23 can thus be formed in a depth and a width w with an accuracy of $\pm 10$ μm.

In assembling the color screen structure, an external force is applied to the supporting members 1 and 2 of the frame 5 to deflect the supporting members 1 and 2 toward each other by a fixed deflection, the aperture grill member 21 is placed on the supporting members 1 and 2 with a tensile force applied thereto in directions Y—Y to hold the aperture grill member 21 tight, and then the aperture grill member 21 is seam-welded to the supporting members 1 and 2. In FIG. 1. welded seams 16 are shown. After welding the aperture grill member 21 to the frame 5, the external force is removed from the supporting members 1 and 2, and then a tearing force F on the order of 300 g is applied to the aperture grill member 21 to tear off the unnecessary peripheral portions 8 along the grooves 23. In this embodiment, the opposite ends of the grooves 23 merge into the slots 22A and 22B. However, if the bottom walls of the grooves 23 are unable to withstand a tensile stress of 10 $kg/m^2$ or below, which is applied to the aperture grill member 21 in extending the same on the frame 5, the opposite ends of the grooves 23 may be terminated before the slots 22A and 22B to form ungrooved portions having a width Ω (FIG. 4) in the range of 0.2 to 1 mm between the opposite ends of the grooves 23 and the slots 22A and 22B.

Preferably, the depth d of the grooves 23 is 30 μm or below when the thickness t of the aperture grill member 21 is 80 μm, and is 40 μm or below when the thickness t is 180 μm.

Thus, according to the method of manufacturing a color screen structure for a CRT, in accordance with the present invention, the unnecessary portions 8 of the aperture grill member 21 can be torn off along the grooves 23 extending along the outer upper edges of the supporting member 1 and 2 simply by applying a small tearing force F on the order of 300 g to the aperture grill member 21 without producing metallic scraps such as burrs and chips, after welding the aperture grill member 21 to the supporting members 1 and 2 of the frame 5.

Accordingly, the method of the present invention has the following advantages.

Figure 8:
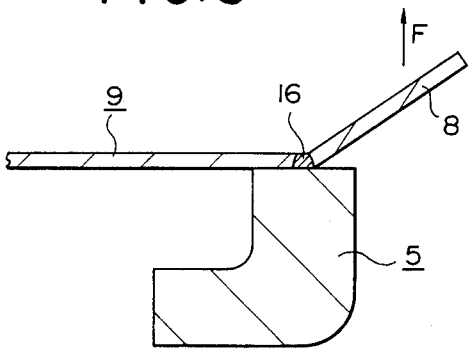
FIG. 8 is a fragmentary sectional view of color screen structure, of assistance in explaining another conventional method of cutting off the unnecessary peripheral portions of a color screen member.

Tearing the unnecessary peripheral portions 8 along the welded seams 16 by the method of the present invention as shown in FIG. 1 requires a very small tearing force which is approximately one-tenth of the tearing force in the range of 3 to 5 kg required by the conventional method described with reference to FIG. 8. Accordingly, the method of the present invention does not require large equipment investment and requires merely the least necessary modification of the existing manufacturing equipment.

Since the method of the present invention is simple and stable, the yield of the product is improved.

Whereas the inclination 8 of the outer side walls of the supporting members 1 and 2 of the frame 5 must be controlled strictly in carrying out the conventional method described with reference to FIG. 7 employing the roller cutter for shearing off the unnecessary peripheral portions 8 exactly without being directly affected by the variation of the inclination $\Theta$, and hence the accuracy of the control of the inclination is relaxed.

Figure 7:
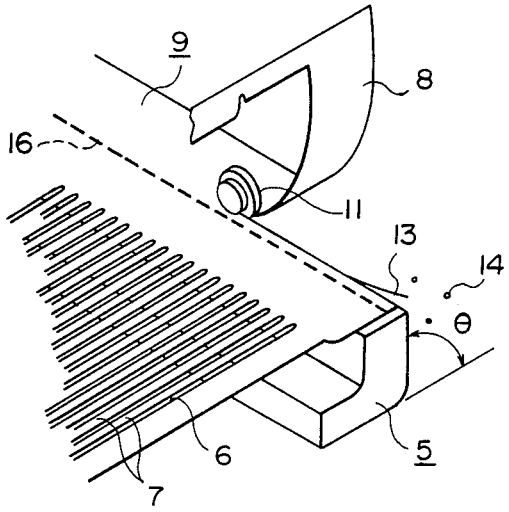
FIG. 7 is a fragmentary perspective view of the color screen structure of FIG. 6, of assistance in explaining a conventional method of cutting off the unnecessary peripheral portions of an aperture grill member.

Furthermore, whereas the conventional method employing the roller cutter for shearing off the unnecessary portions 8 as shown in FIG. 7 inevitably entails metallic scraps adhering to the aperture grill scattering over the working stage for processing the aperture grill and dropping into the washing tank of the subsequent washing process to promote the pollution of the washing liquid, the method of the present invention produces no metallic scrap, hence the pollution of the washing liquid is avoided and the working environment is improved.

Still further, since the method of the present invention does not need any roller cutter, the method of the present invention eliminates work for inspecting and repairing the cutting edge of the roller cutter.

Although the invention has been described in its preferred form with a certain degree of particularity, obviously many changes and variations are possible therein. It is therefore to be understood that the present invention may be practiced otherwise than specifically described herein without departing from the scope and spirit thereof.

We claim as our invention:

1. A method of manufacturing a color screening structure for a CRT, comprising steps of:

forming a frame by placing a pair of supporting members substantially in parallel to each other and interconnecting the respective opposite ends of the pair of supporting members by a pair of connecting members;

forming grooves in a color screen member having a plurality of parallel slits in a color screen region thereof and a pair of slots respectively extending outside and alongside the outermost slits so as to extend respectively along lines corresponding to the outer upper edges of the pair of supporing members;

welding the color screening member to the pair of supporting members of the frame so that the grooves of the color screen member extend respectively along the outer upper edges of the supporting member; and tearing off the unnecessary peripheral portions of the color screening member along the grooves.

2. A method of manufacturing a color screen structure for a CRT according to claim 1, wherein said grooves are formed in the backside of the color screen member.

3. A method of manufacturing a color screening structure for a CRT according to claim 1, wherein the opposite ends of each groove merge into the slots.

4. A method of manufacturing a color screen structure for a CRT according to claim 1, wherein the opposite ends of each groove terminate respectively before the slots.

5. A method of manufacturing a color screen structure for a CRT according to claim 4, wherein the grooves are formed by etching.

6. A method of manufacturing a color screen structure for a CRT according to claim 1, wherein the grooves are formed by etching.

* * * * *